US005794773A

United States Patent [19]

Moyer

[11] Patent Number: 5,794,773

[45] Date of Patent: Aug. 18, 1998

[54] BOWLING BALL CARRIER

[76] Inventor: Patricia L. Moyer, 229 Cedarwood Dr., Maitland, Fla. 32751

[21] Appl. No.: 418,193

[22] Filed: Apr. 7, 1995

[51] Int. Cl.[6] ..... A63B 47/00

[52] U.S. Cl. ..... 206/315.91; 206/523

[58] Field of Search ..... 206/315.9, 315.91, 206/579, 523; 190/18 A, 115

[56] References Cited

U.S. PATENT DOCUMENTS

| | | | |
|---|---|---|---|
| D. 270,302 | 8/1983 | Starzec | D3/36 |
| 3,029,855 | 4/1962 | Telford | 206/315.91 |
| 3,690,360 | 9/1972 | Cahill, Jr. | 150/52 A |
| 4,166,530 | 9/1979 | Robinson | 206/315.91 |
| 4,311,223 | 1/1982 | Stein | 206/315.91 |
| 4,433,781 | 2/1984 | Hummel | 206/523 |
| 4,553,667 | 11/1985 | Hudson et al. | 206/315.9 |
| 4,836,374 | 6/1989 | Hutchins et al. | 206/523 |
| 5,074,571 | 12/1991 | Reese | 280/47.19 |
| 5,135,275 | 8/1992 | Kettelson | 294/16 |
| 5,330,037 | 7/1994 | Wang | 190/18 A |

*Primary Examiner*—Thomas P. Hilliard

*Attorney, Agent, or Firm*—David L. Baker; Rhodes & Ascolillo

[57] ABSTRACT

The invention is a protective travel container for carrying one or two bowling balls and ancillary equipment. The hard cover container is filled with impact absorbing foam padding containing recesses to secure the balls and equipment in place. One handle is provided for lifting and another along with wheels for pulling the container.

4 Claims, 1 Drawing Sheet

BOWLING BALL CARRIER

BACKGROUND OF THE INVENTION

1. Field of the invention

This invention relates generally to a protective device for carrying bowling balls and more specifically to such a device that allows one or more bowling balls to be easily and conveniently moved from place to place.

2. Description of the prior art

Through out the year and in particular during the bowling season professional bowlers travel continuously from city to city, either competing or engaging in demonstrations and promoting products they have endorsed. When the bowler, professional or not, travels he carries the tools of his trade in the form of a bowling ball or two, shoes and of course wearing apparel. Travelers are aware that traveling is hard on their luggage and that bowling balls are not permitted as "carry on" baggage by the airlines. Checked luggage at the air line counter is forced to undergo more unusual and unexpected forces between departure and arrival than if the luggage were in the possession of the owner. The containers normally used to transport bowling balls are constructed from light weight material usually with a solid base and a pair of handles on the top to carry the combination. These containers offer no real protection for their contents and when the bowling ball is placed in the luggage "check in" system as required, it frequently arrives in the retrieval cargo bins in with some damage. A professional bowling ball is damaged beyond use by a nick or scratch, particularly for those balls used in high stakes competition. A new ball will cost in the order of hundreds of dollars, assuming that the bowler is able to find his favorite ball.

Examples of prior art bowling ball carrying containers are shown and described in U.S. Patents including a design U.S. pat. No. Des. 270,302 issued Aug. 30, 1983 to Starzec. Other U.S. Patents include U.S. Pat. No. 3,690,360 issued Sep. 12, 1972 to Cahill, Jr. who includes a movable frame in the container to permit access to the contents in the case besides the bowling ball. U.S. Pat. No. 4,553,667 issued Nov. 19, 1985 to Hudson et al shows a cylindrical container made to resemble a beverage container with a handle in the top where the bowling ball and other equipment are simply dropped into the container and the cover twisted on. A multiple bowling ball carrier is disclosed in U.S. Pat. No. 5,074,571 issued Dec. 24, 1991 to Reese which three storage compartments for bowling balls, a drawer for accessory equipment, wheels to aid in movement and a handle for lifting the carrier. A simple bowling ball carrier is put forth by Kettelson in U.S. Pat. No. 5,135,275 issued Aug. 4, 1992. The invention consists of a hinged frame with large apertures that allow a portion of the ball to pass through. The diameter of the apertures is less than the diameter of the bowling ball. The frame is brought together and each section contains a hand grip which are joined together for closing the frame and carrying the ball.

The prior art as known to the Applicant and as demonstrated in these U.S. Patents taken alone or in combination with the cited references or other references fail to anticipate this disclosure and its appended claims to invention.

SUMMARY OF THE INVENTION

The invention is characterized by a container having a hard shell outer surface that is adapted to be carried with one hand or alternatively wheeled behind the user and transport one or more bowling balls and accessory equipment. The container is formed of two rectangular sections that are hinged at one side and have a third dimension giving the joined sections sufficient depth to enclose an object the size of a bowling ball. The container thus formed includes latching mechanisms on the side opposed from the hinge that secure the joined sections in the closed condition and a handle for lifting and transporting the container. Wheels are provided on each corner of hinged side to allow the container to be pulled by another handle located on one end of the container.

The interior of the container contains a dense foam padding containing recessed voids adapted to receive one or more bowling balls. Each section contains a mating void so that one section will substantially surround and protect one half the bowling ball. When the two sections are joined in the closed condition the each ball is surrounded by a protective padding.

Also included are recessed voids that will accept shoes, towels and other equipment.

It is therefore an object of the invention to provide a new and improved bowling ball carrier.

It is another object of the invention to provide a new and improved bowling ball carrier that will protect a bowling ball through the rigors of air travel.

It is a further object of the invention to provide a new and improved bowling ball carrier that is light in weight and impact resistant.

It is still another object of the invention to provide a new and improved bowling ball carrier that will carry bowling accessories in addition to the bowling ball.

It is still a further object of the invention to provide a new and improved bowling ball carrier that will carry more than one ball.

It is another object of the invention to proved a new and improved bowling ball carrier that is susceptible of low cost of manufacture and accordingly susceptible of low prices of sale to the consuming public.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawing and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
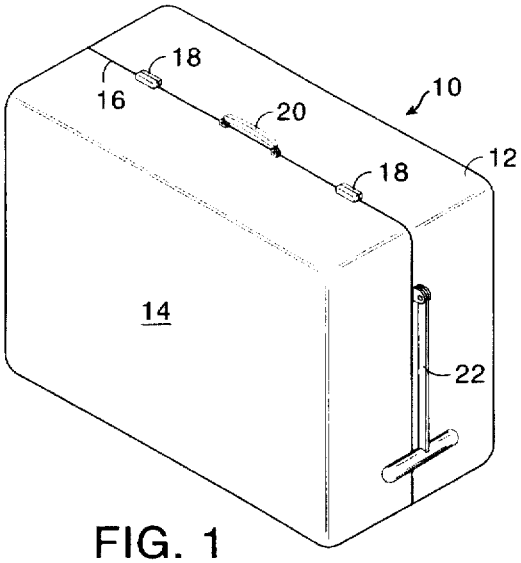
FIG. 1 is a perspective view of the invention.

Referring now to FIG. 1, the invention is shown generally at 10 and is formed from impact resistant fiberglass or the plastic material with similar qualities. The sections 12, 14 are joined along the seam 16 and secured by locking latches 18. A handle is provided along the seam to allow the container to be lifted and carried. An additional T-shaped handle 22 is attached at one end to allow the container to be pulled on wheels provided.

Figure 2:
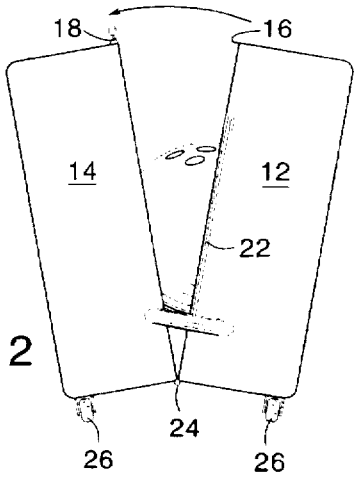
FIG. 2 is an end view of the invention in a semi-open condition.

In FIG. 2 the container is open partly with sections 12 and 14 separated along the seam 16 after release of the latches 18. The sections swing apart at the top and move about the hinge 24 located along the bottom seam 16. Wheels 26 allow the container to be pulled by the T-shaped handle 22.

Figure 3:
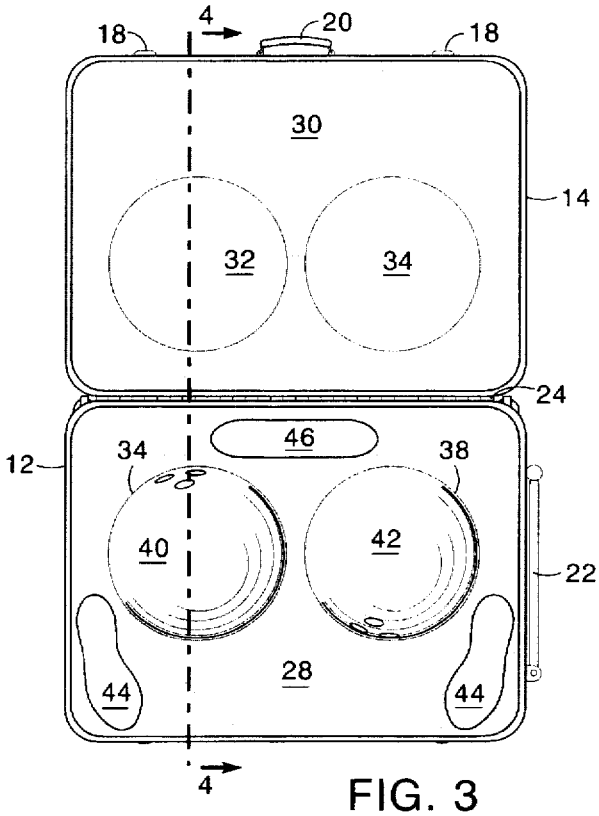
FIG. 3 is a top plan view of the invention in the open condition showing the interior of the container for two balls.

Concerning FIG. 3, the container sections 12 and 14 are filled with shock absorbing dense foam padding 28 and 30 and contain a pair of complementary recessed voids 32,34 and 36,38 adapted to receive bowling balls 40,42. Additional recessed voids are 44 are included in at least one section for storing shoes and a recessed void 46 for carrying other accessories. Additional voids may be added for transporting other tools or equipment.

Figure 4:
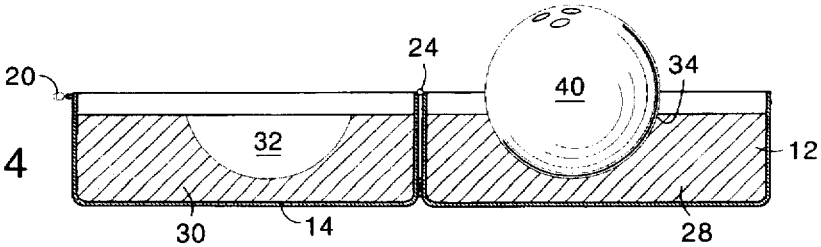
FIG. 4 is a cross sectional view of the invention taken along lines 4—4 of FIG. 3.

FIG. 4 shows sections 12 and 14 in the full open condition. Hinge 24 connects the sections which are filled with shock absorbing dense foam padding 28 and 30. Recessed areas 32 and 34 are adapted to receive the bowling ball 40. When the container is closed, recessed area 32 will surround the exposed section of the ball 40 thereby causing it to be secure and protected from abusive shock and force.

Figure 5:
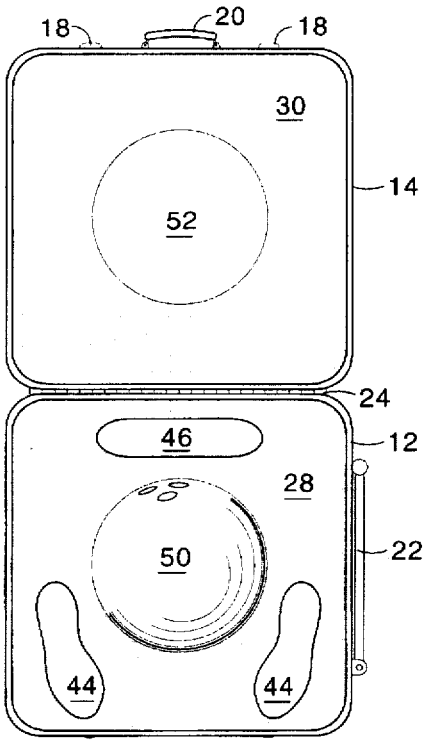
FIG. 5 is a top plan view of the invention in the open condition showing the interior of the container for a single ball.

The container shown in FIG. 5 differs from FIG. 4 in that the container may be reduced in size and the shock absorbing material provide recessed areas 50,52 for one bowling ball along with shoe area 44 and accessory area 46. The container is in all other respects the same as the container in FIG. 1.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A protective bowling ball carrier comprising:

a first container comprising:

a first shell;

a bottom on the first shell; and four upstanding sides on the first shell;

a second shell;

a bottom on the second shell; and four upstanding sides on the second shell;

a hinge connecting the first shell and the second shell whereby the first and the second shell are closable container;

means for locking the first and second shell together, in a closed condition located adjacent a common seam between the first and the second shells, on a side opposed to the hinge;

a first handle means connected to the first container proximate said locking means for lifting the first container;

wheel members mounted on an exterior of the first container in the proximity of the hinge;

a second handle member, mounted on the first container, for pulling the first container on said wheel members;

padding means in the first shell and in the second shell forming a second container in the first container when the first container is in the closed condition;

semi-hemispherical bowling ball recesses in the padding means contained in the first shell and in the second shell;

a first shoe-shaped bowling shoe recess in the padding means;

a second shoe-shaped bowling shoe recess in the padding means; and a bowling accessory recess in the padding means.

2. A protective bowling ball carrier according to claim 1 wherein each shell is formed of impact resistant fiberglass material.

3. A protective bowling ball carrier according to claim 1 wherein said padding means is impact absorbing foam padding.

4. A protective bowling ball carrier according to claim 1 further including additional bowling ball recesses for a second ball.

* * * * *